United States Patent [19]

Okumura

[11] Patent Number: 4,825,660

[45] Date of Patent: May 2, 1989

[54] CRYOGENIC REFRIGERATOR

[75] Inventor: Nobuo Okumura, Toyota, Japan

[73] Assignee: Aisin Seiki Kabushiki Kaisha, Kariya, Japan

[21] Appl. No.: 54,781

[22] Filed: May 27, 1987

[30] Foreign Application Priority Data

Jun. 11, 1986 [JP] Japan ..... 61-088917[U]

[51] Int. Cl.[4] ..... F25B 9/00

[52] U.S. Cl. ..... 62/6; 62/228.3

[58] Field of Search ..... 62/6, 196.4, 209, 228.1, 62/230, 228.3

[56] References Cited

U.S. PATENT DOCUMENTS

| | | | |
|---|---|---|---|
| 3,939,668 | 2/1976 | Morris | 62/196.4 |
| 4,417,448 | 11/1983 | Horn et al. | 62/6 |
| 4,686,834 | 8/1987 | Haley et al. | 62/209 |
| 4,706,470 | 11/1987 | Akazawa et al. | 62/228.3 |

FOREIGN PATENT DOCUMENTS 60-8482 1/1985 Japan .

*Primary Examiner*—Henry A. Bennet

*Attorney, Agent, or Firm*—Burns, Doane, Swecker & Mathis

[57] ABSTRACT

A cryogenic refrigerator has a working chamber defined between a cylinder and a piston received therein. The working chamber is alternately communicated with discharge and suction ports of a compressor to thereby cause a refrigerant to be repeatedly compressed and expanded. The refrigerator is provided with a sensor for detecting the pressure of the refrigerant discharged from the discharge port of the compressor. A microcomputer is connected to the sensor for making comparison between the detected pressure of the refrigerant, which is received in the form of an electric signal, and a reference value. The refrigerator is further provided with a driver circuit for controlling the drive of the motor in accordance with the result of the comparison. Accordingly, when the pressure of the refrigerant is high at the time of starting the cryogenic refrigerator, the microcomputer instructs the driver circuit to rotate a motor at high speed. Thus, the reciprocating cycle of the piston driven by the motor is quickened, so that it is possible to bring the refrigerator into a stable or stationary operation state in a relatively short period of time.

3 Claims, 1 Drawing Sheet

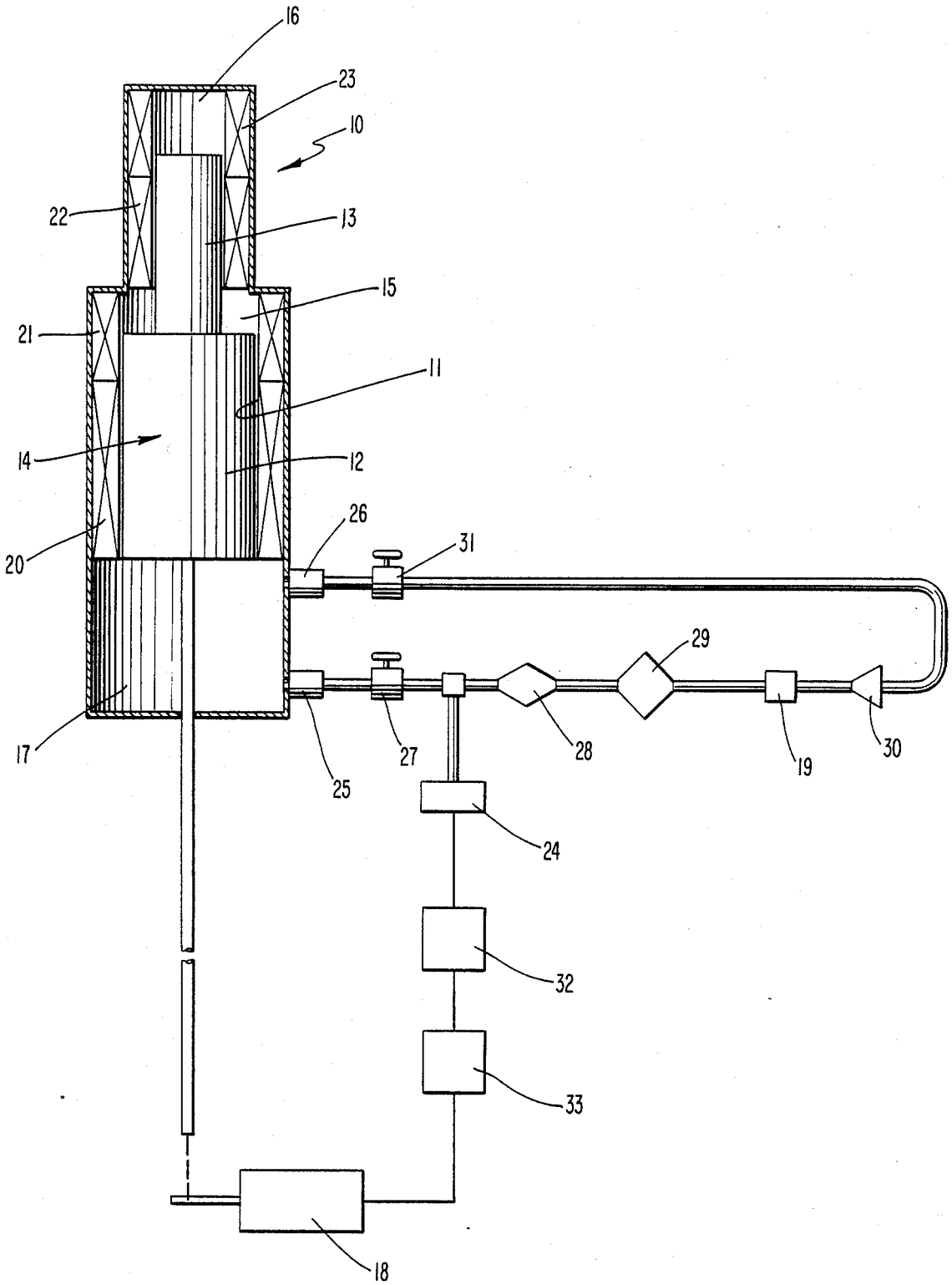
16
23
10
22
13
15
21
11
14
12
26
31
20
29
17
25
27
28
19
30
24
32
33
18

CRYOGENIC REFRIGERATOR

BACKGROUND OF THE INVENTION

1. Field of the Invention

The present invention relates to a cryogenic refrigerator and, more particularly, to a cryogenic refrigerator using a cycle such as Gifford-McMahon cycle.

2. Description of the Related Art

A typical conventional cryogenic refrigerator of the type described above is arranged such that a refrigerant such as helium or the like is circulated between a compressor and a working chamber defined between a piston and a cylinder in response to the opening and closing operation of a valve activated in synchronism with the movement of the piston, and when the refrigerant is adiabatically expanded in the working chamber, a cryogenic temperature is generated in the cylinder.

This type of conventional cryogenic refrigerator suffers, however, from the following disadvantages.

At the time of starting the refrigerator, the working chamber needs to be filled with the refrigerant, but, in this case, it suffices to deliver a relatively small amount of refrigerant from the compressor. However, since the delivery capacity of the compressor is constant, the refrigerant the pressure of which is excessively high at the time of starting the refrigerator must be fed back to the suction side of the compressor through a relief valve. For this reason, the capacity of the compressor cannot fully be used, and much time is required to bring the cryogenic refrigerator into a stable operation state after it has been started, which means that the machine involves disadvantageously low efficiency.

SUMMARY OF THE INVENTION

In view of the above-described circumstances, it is a primary object of the present invention to provide a cryogenic refrigerator which is so designed that it is possible to reduce the period of time which is required for the refrigerator to reach a stable operation state after it has been started.

To this end, the present invention provides a cryogenic refrigerator wherein the cubic volume of a working chamber defined between a cylinder and a piston received therein repeatedly decreases and increases in response to the reciprocating movement of the piston caused by the operation of an electric motor, and the working chamber is communicated with discharge and suction ports of a compressor when the volume of the working chamber decreases and increases, respectively, so that a refrigerant is repeatedly compressed and expanded, the refrigerator comprising: a sensor for detecting the pressure of the refrigerant discharged from the discharge port of the compressor; a microcomputer connected to the sensor for making comparison between the detected pressure of the refrigerant, which is received in the form of an electric signal, and a reference value; and a driver circuit for controlling the drive of the motor in accordance with the result of the comparison.

Accordingly, when the pressure of the refrigerant is high at the time of starting the cryogenic refrigerator, the microcomputer instructs the driver circuit to rotate the motor at high speed. Thus, the reciprocating cycle of the piston driven by the motor is quickened, so that it is possible to bring the refrigerator into a stable or stationary operation state in a relatively short period of time.

The above and other objects, features and advantages of the present invention will become more apparent from the following description of the preferred embodiment taken in conjunction with the accompanying drawing.

BRIEF DESCRIPTION OF THE DRAWING

The attached sole figure illustrates one embodiment of the cryogenic refrigerator according to the present invention.

DESCRIPTION OF THE PREFERRED EMBODIMENT

One embodiment of the present invention will be described hereinunder in detail with reference to the accompanying drawing.

A cryogenic refrigerator 10 includes a stepped cylinder 11 which has a stepped piston 14 reciprocatively received therein, the piston 14 having an integral structure that consists of a relatively large diameter portion 12 and a relatively small diameter portion 13. A first working chamber 15, a second working chamber 16 and a space 17 are defined between the stepped cylinder 11 and the stepped piston 14. The cubic volume, or capacity, of each of the three changes in accordance with the reciprocating movement of the piston 14 driven by means of an electric motor 18. The space 17 is communicated with the first working chamber 15 through a regenerator 20 and a first freezer 21. The first working chamber 15 is, in turn, communicated with the second working chamber 16 through a regenerator 22 and a second freezer 23.

The space 17 has first and second ducts 25 and 26, the first duct 25 being communicated with the discharge port of a compressor 30 through a first valve 27, a filter 28, an oil separator 29 and a cooler 19, and the second duct 26 being communicated with the suction port of the compressor 30 through a second valve 31. The pressure in the pipe between the first valve 27 and the filter 28 is detected by means of a pressure sensor 24, from which it is delivered to a microcomputer 32 in the form of an electric signal. The electric signal is compared with a reference value in the microcomputer 32. When the detected pressure is higher (lower) than the reference value, a driver circuit 33 activates the motor 18 to run at relatively high speed (at relatively low speed).

When the stepped piston 14 moves downward as viewed in the figure, the first valve 27 is closed, while the second valve 31 is opened, so that the refrigerant is sucked into the compressor 30, and the respective volumes of the first and second working chambers 15 and 16 increase, resulting in refrigeration occurring in these working chambers. When the piston 14 moves upward, the first valve 27 is opened, while the second valve 31 is closed, and the refrigerant is thereby supplied to the space 17, the first working chamber 15 and the second working chamber 16. Before entering the first chamber 15, the refrigerant passes through the regenerator 20 where it exchanges heat with cold air stored therein. Further, before entering the second working chamber 16, the refrigerant passes through the regenerator 22 where it exchanges heat with cold air stored therein.

Thus, when the refrigerator 10 is started, if the pressure of the refrigerant is high, the motor 18 is rotated at high speed to quicken the reciprocating cycle of the piston 14, thus enabling the refrigerator 10 to be relatively quickly brought into a stable or stationary operation state.

As has been described above, the present invention provides a cryogenic refrigerator wherein a working chamber defined between a cylinder and a piston received therein is alternately communicated with discharge and suction ports of a compressor to therey cause a refrigerant to be repeatedly compressed and expanded, the refrigerator comprising: a sensor for detecting the pressure of the refrigerant discharged from the discharge port of the compressor; a microcomputer connected to the sensor for making comparison between the detected pressure of the refrigerant, which is received in the form of an electric signal, and a reference value; and a driver circuit for controlling the drive of the motor in accordance with the result of the comparison.

Accordingly, when the pressure of the refrigerant is high at the time of starting the cryogenic refrigerator, the microcomputer instructs the driver circuit to rotate the motor at high speed. Thus, the reciprocating cycle of the piston driven by the motor is quickened, so that it is possible to bring the refrigerator into a stable or stationary operation state in a relatively short period of time.

Although the present invention has been described through specific terms, it should be noted here that the described embodiment is not necessarily exclusive and various changes and modifications may be imparted thereto without departing from the scope of the invention which is limited solely by the appended claim.

What is claimed is:

1. A cryogenic refrigerator, comprising:

a cylinder and a piston received therein;

a working chamber defined between the cylinder and the piston, the volume of said working chamber repeatedly decreases and increases in response to a reciprocating movement of said piston;

an electric motor for causing the reciprocating movement of said piston;

a compressor;

a discharge port and a suction port of the working chamber for communicating with the compressor when the volume of said working chamber decreases and increases, respectively, so that a refrigerant is repeatedly compressed and expanded;

a sensor for detecting the pressure of the refrigerant discharged from the discharge port of said compressor;

a microcomputer connected to said sensor for making a comparison between the detected pressure of said refrigerant, which is received in the form of an electric signal, and a reference value; and a driver circuit for controlling the drive of said motor in accordance with the result of said comparison.

2. The cryogenic refrigerator of claim 1, wherein the refrigerator is of the Gifford-McMaphon cycle type.

3. The cryogenic refrigerator of claim 1, wherein the driver circuit is adapted to drive the motor at a high speed when the detected pressure is greater than the reference value and to drive the motor at a low speed when the detected pressure is less than the reference value.

* * * * *